United States Patent [19]

Guzorek

[11] Patent Number: 5,012,793

[45] Date of Patent: May 7, 1991

[54] POWER VENTED DIRECT VENT SYSTEM

[75] Inventor: Steven E. Guzorek, Kinston, N.C.

[73] Assignee: The Field Controls Company, Kinston, N.C.

[21] Appl. No.: 417,476

[22] Filed: Oct. 5, 1989

[51] Int. Cl.[5] ..... F24C 3/00

[52] U.S. Cl. ..... 126/85 B; 126/293; 126/307 R; 98/48

[58] Field of Search ..... 126/85 B, 80, 301, 312, 126/307 R; 98/48

[56] References Cited

U.S. PATENT DOCUMENTS 3,521,582 7/1970 Liden ..... 126/85 B X 4,335,704 6/1982 Wingstrom et al. ..... 126/293

4,424,792 1/1984 Shimek et al. ..... 126/80

4,757,802 7/1988 Guzorek ..... 126/80

*Primary Examiner*—Larry Jones

*Attorney, Agent, or Firm*—Wood, Phillips, Mason, Recktenwald & VanSanten

[57] ABSTRACT

A power vented direct vent system for a fuel-burning appliance wherein a power venter is associated with a vent pipe to create adequate draft for combustion. Outside air is supplied to the appliance for combustion and also communicates through a regulator with the vent pipe for addition to the flue gases. The draft regulator assures adequate draft and can be a barometric draft control. The power vented direct vent system is directly connected to the fuel-burning appliance with complete isolation of the combustion system from the space in which the appliance is located.

5 Claims, 1 Drawing Sheet

Fig. 1
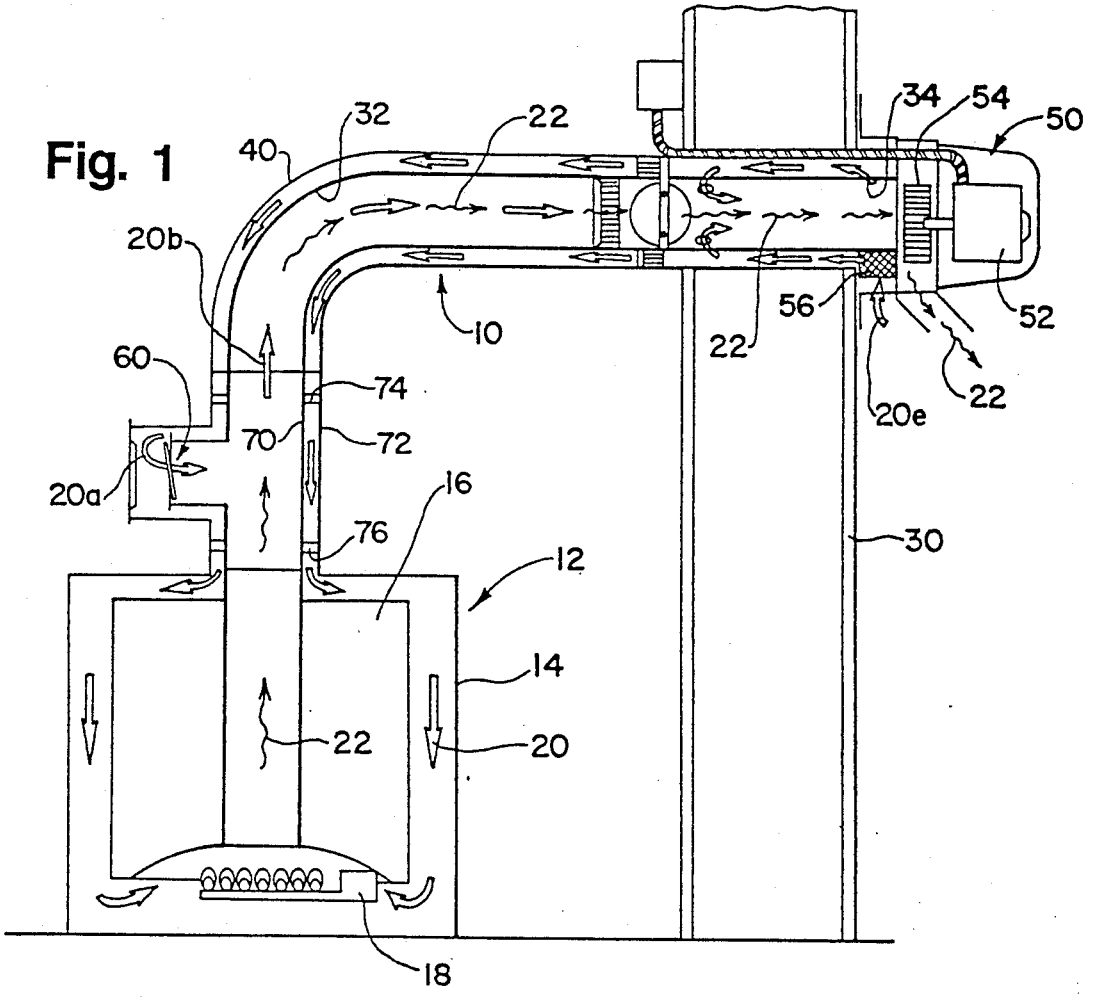
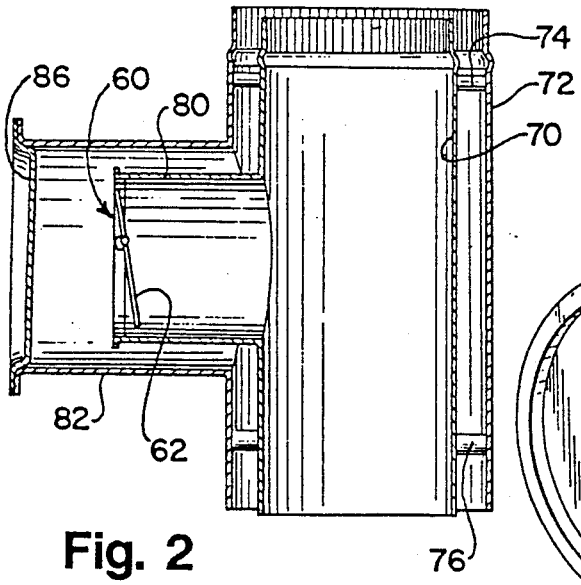
Fig. 2
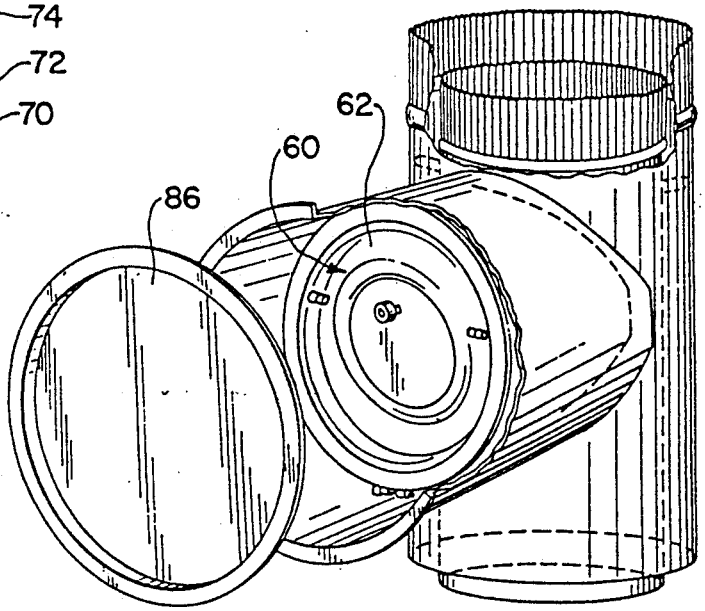
Fig. 3

POWER VENTED DIRECT VENT SYSTEM

DESCRIPTION

1. Field of the Invention

This invention pertains to a power vented direct vent system for a fuel-burning appliance and, more particularly, to such a system which adds power venting to a direct vent system. The system is completely isolated from the space in which the appliance is located. Outside air is used to supply both combustion air and flue gas diluent air and the air flow is controlled to assure sufficient draft at the burner of the fuel-burning appliance.

2. Background of the Invention

A-burning appliance, such as a furnace, is typically connected to a chimney. For proper combustion, it is necessary that "draft" exist in the appliance. The term "draft" as it applies to combustion describes the force responsible for moving air into the fuel-burning appliance over the burner and out through the chimney. This air provides a source of oxygen necessary for combustion and leaves the appliance with the oxygen therein used in the combustion process exiting the chimney as flue gas.

The draft is the result of a static pressure differential. The static pressure outside the fuel-burning appliance must be greater than the static pressure inside the appliance. This static pressure differential is dependent on temperature and chimney height in the conventional installation of a furnace. There are now many installations of a fuel-burning appliance wherein a chimney is not available, such as mobile homes, or is not used. In such instances, a direct vent system is associated with the appliance. In a direct vent system, air needed for combustion is taken from outside the building and exhausted back outside of the building. No interior air is used in the combustion process. There are a number of direct vent systems on the market wherein outside air flows to the fuel-burning appliance in a passage defined between an inner vent pipe and an outer air intake pipe. The direct vent systems which are of the passive type and merely rely upon air flows dependent upon temperature differences are limited in application and the capacity to provide adequate draft is reduced by the cooling effect of the outside air flowing between the outer and inner pipes. The actual amount of draft (or negative pressure) created by a passive-type direct system is relatively small.

The addition of a mechanical air moving device, such as a power center, to a direct vent system causes the system to function as if the inner vent pipe was essentially longer, thus causing a higher than normal draft (negative pressure) at the burner of the appliance.

The invention disclosed herein functions in a power vented direct vent system to assure that outside air which flows to both the appliance and the vent pipe is controlled in its flow to the vent pipe to provide proper draft at the burner.

The Ryder Patent No. 2,711,683 is a general shOWing of an attempt to utilize outside air as an insulating layer surrounding a vent pipe as well as to provide air for combustion and air for dilution of flue gases. Ryder does not provide outside air directly to the appliance, but provides make up air to the room where the appliance operates. Ryder does not have the combustion system isolated from the building. There is no disclosure in this patent of controlling the amount of outside air that can flow to the vent pipe and, therefore, there is a possibility that most of the outside air, which is make up air, can go into the vent system allowing for insufficient draft at the burner.

SUMMARY OF THE INVENTION

A primary feature of the invention is to provide a power vented direct vent system for a fuel-burning appliance, such as a furnace or hot water heater, wherein the combustion system is completely isolated from the building housing the appliance and there is control of the flow of outside air to assure proper draft at the burner.

An object of the invention is to provide a power vented direct vent system for a fuel-burning appliance wherein a vent pipe is connectable to the appliance and has an outlet end external of a building for flow of flue gas to the outside, a blower is mounted to create a draft in the vent pipe, an intake pipe surrounds the vent pipe for insulating the vent pipe and directing outside air to the appliance for combustion, the intake pipe also being connected to the inner end of the vent pipe for direct flow of outside air to the inlet end of the vent pipe, and regulatory means controls the amount of outside air that can flow from the intake pipe to the vent pipe in order to assure adequate draft at the burner of the appliance.

Still another object of the invention is to improve a direct vent system for a fuel-burning appliance by the addition of a power center thereto and with said improvement including means to control the ratio of intake air delivered to the burner of the combustion device relative to the air delivered from an intake pipe to a vent pipe for mixture with flue gases in order to assure sufficient draft at the burner.

Still another object of the invention is to provide a power vented direct vent system for a fuel-burning appliance comprising, a vent pipe extendable from a fuel-burning appliance for conveying flue gas to an outlet end of the vent pipe at a discharge location outside of a building, means including an intake pipe and a blower for supplying make up air from outside the building to the appliance, said intake pipe and vent pipe communicating at a location between the blower and the appliance, and means for controlling the amount of make up air which flows directly from the intake pipe to the vent pipe to assure sufficient draft at the burner of the appliance.

Still another object of the invention is to provide a power vented direct vent system for a fuel-burning appliance comprising, a vent pipe connectable to the appliance and having a length to have an outlet end outside a building, a blower mounted to the vent pipe for drawing flue gas therethrough for discharge from said outlet end, an intake pipe surrounding said vent pipe in spaced relation to define an air passage for flow of outside air from an inlet end to an outlet end thereof, the outlet end of the intake pipe being connectable to the appliance to provide air for combustion, the ends of said vent pipe-.and intake pipe which are connectable to the appliance each having a tee adjacent an end thereof, the intake pipe tee having a lateral section with a closed end, the vent pipe tee having a lateral section inwardly of and spaced from the intake pipe tee lateral section, the vent pipe tee lateral section having an open end at a distance from the closed end of the intake pipe tee lateral section, and a barometric draft control mounted in the open end of the vent pipe tee lateral section.

DESCRIPTION OF THE DRAWINGS

FIG. 1 is a vertical section of the power vented direct vent system shown in association with a diagrammatically-illustrated fuel-burning appliance and a building wall;

FIG. 2 is a vertical section, on an enlarged scale of a part of the power vented direct vent system located immediately above the fuel-burning appliance; and FIG. 3 is a perspective view of the structure shown in FIG. 2, with parts broken away and disassembled.

DESCRIPTION OF THE PREFERRED EMBODIMENT

The power vented direct vent system, indicated generally at 10, is shown in FIG. 1 in association with a fuel-burning appliance, such as a furnace or a hot water heater, indicated generally at 12. The fuel-burning appliance 12 is shown as a furnace and has an outer shell 14 which houses a heat exchanger 16 overlying a burner 18. The appliance 12 has suitable ducts (not shown) for flow of return air to the heat exchanger and flow of heated air from the heat exchanger to a room.

Flow of air in the appliance 12 is indicated by the open body arrows 20. This is outside air which reaches the appliance through the direct vent system to be described.

Flue gas flowing from the appliance is indicated by wavy line arrows 22, with these gases flowing upwardly centrally of the heat exchanger 16 and out of the appliance.

The direct vent system is associated with the appliance 12 and a building wall, indicated generally at 30. The direct vent system includes an inner pipe which is a vent pipe 32 which is connectable to the top of the appliance and which extends through the building wall 30 and has an outlet end 34 for exhausting flue gases to the outside of the building.

The direct vent system also includes an outer pipe 40 functioning as an intake pipe for outside air, with the intake pipe 40 concentric with the vent pipe 32 and spaced therefrom to form an annular air passage for outside air. This air enters the intake pipe at an opening located outside the building wall, as indicated by one of the arrows 20*e* and flows in surrounding relation to the vent pipe 32. A screen 56 covers the opening for intake of outside air and this outside air flows around that portion of the vent pipe that is positioned in the building wall to assist in insulating the vent pipe. The outside air flows downwardly to the appliance 12 to supply combustion air.

A power venter, indicated generally at 50, is associated with the outlet end 34 of the vent pipe and may be of the same basic construction as shown in my U.S. Pat. No. 4,757,802. The power venter 50 has a motor 52 which drives a blower 54 with flue gases 22 received at the eye of the blower and discharged radially therefrom. The power venter disclosed herein differs from that shown in my prior patent in having the outer pipe in continuous air flow communication with the appliance, rather than having the outer pipe blocked. As a result, outside air can flow from outside the building all the way to the appliance.

The power venter 50 functions in place of a chimney to provide the necessary draft for the fuel-burning appliance. The power venter causes the direct vent system to act like an extra long vent pipe and this can cause higher than normal negative pressure at the burner, with resulting excessive draft.

In order to control negative pressure at the burner, a regulation device is part of the system and functions to control the amount of outside air that flows to the appliance and directly into the vent pipe for cooling and dilution of the flue gases. This assures sufficient draft at the burner of the appliance. This regulation device can be a manual adjustment damper or variable size orifice openings or, as shown, a barometric draft control, indicated generally at 60.

The assignee of this invention sells many forms of barometric draft controls. Draft controls of this general type are shown in the Field Pat. Nos. 2,433,749 and 2,671,615. A pivotal gate 62 is positionable, in response to differential pressures, to control the size of an opening and, therefore, control air flow therethrough. Reference may be made to the prior Field patents for a detailed description of a suitable barometric draft control.

The connection of the intake pipe 40 to the vent pipe 32 is achieved by means of the structure shown in FIGS. 2 and 3, with each of these pipes having a tee 70 and 72, respectively. The tees are held in spaced assembled relation by upper spacers 74 and lower spacers 76. Each of the tees 70 and 72 has a lateral section 80 and 82, respectively, in surrounding spaced relation with the intake pipe lateral tee 82 having a length greater than that of the vent pipe lateral section A cap 86 is fitted to an open end of the intake pipe lateral section 82 to close off the end. The open end of the vent pipe lateral section 80 pivotally mounts the barometric draft control 60. With this construction, outside air flowing toward the appliance can flow to the appliance and to the vent pipe 32. The amount of flow to the vent pipe 32 is dependent upon the position of the gate 62 of the barometric draft control, with the latter flow being indicated by an arrow 20*a*.

The draft regulator, shown in the form of a barometric draft control, functions to assure that there will be sufficient draft at the burner 18 and avoids the possibility of so much of the intake air going into the vent system that there would be insufficient draft at the burner.

As shown, the tee sections 70 and 72 are located at or adjacent the appliance whereby a part of the make up air can enter into the vent pipe as close to the appliance as possible to assure dilution and immediate cooling of the flue gases. Flow of make up air in the vent pipe is indicated by the arrows 20*b* and the flue gases by the arrows 22. These arrows are shown distinct in the vent pipe for illustrative purposes. However, in actual fact, the air and flue gases will be intermingled, rather than being distinct masses.

I claim:

1. A power vented direct vent system for a fuel-burning appliance comprising, a vent pipe for conveying flue gas to an outlet end of the vent pipe at a discharge location outside of a building and having an inlet end for connection to an appliance, means including an intake pipe and a blower for supplying make up air from outside the building to the appliance, said intake pipe and vent pipe being concentric over substantially their entire extent between the blower and the appliance to define an unobstructed air path for ambient air to the appliance, and means for controlling the amount of make up air which flows directly from the intake pipe to the vent pipe to assure sufficient draft at the burner of the appliance, said controlling means including means for controllably delivering make up air flowing in the unobstructed air path into the vent pipe adjacent to the inlet end of the vent pipe.

2. A power vented direct vent system as defined in claim 1 wherein said means for controlling the amount of make up air flowing from the intake pipe to the vent pipe comprises a barometric draft control.

3. A power vented direct vent system as defined in claim 1 wherein said vent pipe and intake pipe each have a tee with a longitudinal section and a lateral section, means closing off an outer end of the lateral section of the intake pipe at a distance from the open end of the lateral section of the vent pipe, and said means for controllably delivering make up air being mounted in the lateral section of the vent pipe to control the opening thereof.

4. A power vented direct vent system for a fuel-burning appliance comprising, a vent pipe connectable to the appliance and having an inlet end attached to the appliance and an outlet end mountable outside a building, a blower mounted to the outlet end of the vent pipe for drawing flue gas therethrough for discharge from said outlet end, an intake pipe surrounding said vent pipe in spaced relation to define a substantially unobstructed air passage for flow of outside air from an inlet end of the intake pipe to an outlet end thereof as an insulating air layer, the outlet end of the intake pipe being connectable to the appliance to provide air for combustion, each of said vent pipe and intake pipe having a tee adjacent an appliance adjacent an end thereof with the tee on the intake pipe surrounding the tee on the vent pipe, the intake pipe tee having a lateral section with a closed end, the vent pipe tee having a lateral section inwardly of and spaced from the intake pipe tee lateral section, the vent pipe tee lateral section having an open end at a distance from the closed end of the intake pipe tee lateral section whereby air can flow from the intake pipe to the vent pipe for mixture with the flue gas, said intake pipe communicating outside air in the unobstructed air passage through the lateral section of the intake pipe tee and the lateral section of the vent pipe tee into the vent pipe adjacent to the inlet end of the vent pipe adjacent to the appliance and means mounted in the open end of the vent pipe tee lateral section for controlling air flow from the lateral section of the intake pipe to the lateral section of the vent pipe to thereby regulate the draft.

5. A power vented direct vent system as defined in claim 4 wherein said air flow controlling means is a barometric draft control.

* * * * *